United States Patent [19]

Van der Lelij

[11] 4,245,696

[45] Jan. 20, 1981

[54] APPARATUS FOR COOLING HOT GAS

[75] Inventor: Adam J. Van der Lelij, Linschoten, Netherlands

[73] Assignee: Bronswerk B.V., Amersfoort, Netherlands

[21] Appl. No.: 33,192

[22] Filed: Apr. 25, 1979

[30] Foreign Application Priority Data

Apr. 28, 1978 [DE] Fed. Rep. of Germany ..... 2818892

[51] Int. Cl.[3] ..... F28F 9/22

[52] U.S. Cl. ..... 165/134 R; 29/157.4; 165/158; 165/173

[58] Field of Search ..... 165/134, 173, 175, 178, 165/174, 158; 29/157.4

[56] References Cited

U.S. PATENT DOCUMENTS

| | | | |
|---|---|---|---|
| 2,185,928 | 1/1940 | Simpson et al. | 165/158 |
| 2,336,879 | 12/1943 | Mekler | 165/174 |
| 2,537,024 | 1/1951 | Bay | 165/178 |
| 3,356,135 | 12/1967 | Sayre | 165/134 |
| 3,945,431 | 3/1976 | Straub | 29/157.4 |
| 4,106,560 | 8/1978 | Lauro | 165/174 |

FOREIGN PATENT DOCUMENTS

| | | | |
|---|---|---|---|
| 728656 | 12/1942 | Fed. Rep. of Germany | 165/178 |
| 1205121 | 11/1965 | Fed. Rep. of Germany | 165/158 |
| 1294981 | 1/1970 | Fed. Rep. of Germany | 165/158 |
| 1953628 | 5/1971 | Fed. Rep. of Germany | 165/158 |
| 6919308 | 6/1970 | Netherlands | 165/158 |
| 2848 | of 1882 | United Kingdom | 165/110 |

*Primary Examiner*—Sheldon Richter
*Attorney, Agent, or Firm*—Diller, Ramik & Wight

[57] ABSTRACT

In a heat exchanger, a thin tube plate is reinforced by means of a heavy support plate spaced therefrom. The tubes are fixed to the tube plate and pass through enlarged openings in the support plate but are anchored to the support plate by anchoring devices which allow the liquid to be heated to pass from the chamber provided between the two plates through the annular passages between the tubes and the enlarged openings of the support plate.

6 Claims, 2 Drawing Figures

APPARATUS FOR COOLING HOT GAS

The invention relates to an apparatus for cooling hot gas which comprises a vessel having a nest of tubes, the hot gas flowing through the tubes and cooling water or the like flowing round the tubes and the tubes being mounted at one end in a tube plate which closes a hot gas supply chamber. When the hot gas to be cooled has a very high temperature, the hot gas supply chamber must be provided with an insulating layer and as a result, the insulated portion of the inner surface of said chamber assumes almost the same temperature as the gas. If this temperature lies between 1000° and 1500° C., the tube plate is subjected to very high thermal stresses. This means that the tube plate cannot have a thickness greater than 20 to 25 mm. If the liquid chamber is used for generating steam, for example, and high pressures can thus occur, said tube plate is not able to withstand such pressures. This is true in particular when helically wound tubes are used because such tubes cannot transmit forces. The purpose of the invention is to provide an apparatus for cooling hot gas in which a high gas temperature can occur with no detrimental effect and a high pressure is also admissible in the liquid chamber.

According to the invention, the tube plate is of light construction, a heavy support plate is disposed directly behind said tube plate and supported by the vessel wall, the tubes project through openings in the support plate, the tubes rest on the side remote from the tube plate on the support plate via rings secured on the tube which have passage openings for the cooling water or the like which adjoin continuous gaps disposed round the tubes, and the space between the tube plate and the support plate lying therebehind is provided with a supply for the cooling water or the like. In such a construction, the tube plate is supported by the heavy support plate. Due to the gap between the tubes and the wall of the openings in the support plate the tubes are effectively cooled over the entire length. The cooling water or the like flows in constrained manner round the tubes. The tube plate is also effectively cooled on the rear side because the cooling water or the like flows along said side.

In a convenient further development of the invention the supply means for the cooling water or the like is formed by a tube which is led through an opening in the support plate and sealingly secured in the latter and the end of which is secured to the tube plate to provide an additional supporting effect, said tube comprising openings in the portion lying between the tube plate and the support plate. The cooling water or the like is thus supplied centrally. If the gaps between the tube and the support plate are not made too wide, a pressure drop occurs across said gaps so that the cooling liquid is distributed uniformly over said gaps and over the tube plate.

Furthermore, according to the invention, the supply tube for the cooling water or the like is connected to the support plate only on the side of said plate remote from the tube plate and between the portion of the tubes projecting through the support plate and the wall of the opening an encircling gap open at one end is present. In such a construction gap, corrosion is avoided between the vessel wall and the supply tube.

According to the invention, the tube plate is bent at the edges and welded with the edge to the support plate. An additional flange connection for mounting the tube plate is then not necessary.

Finally, according to the invention the rings round the tubes may be fixedly welded and supported by rings fixedly welded thereto or integral therewith with passage openings in central manner in appropriate recessed areas of the support plate disposed round the tubes. Due to the recessed areas, it is ensured that the gap round the tube is of uniform width throughout. This is important for proper uniform cooling of the tubes in the support plate.

BRIEF DESCRIPTION OF THE DRAWING FIGURES

DETAILED DESCRIPTION OF THE INVENTION

Figure 1:
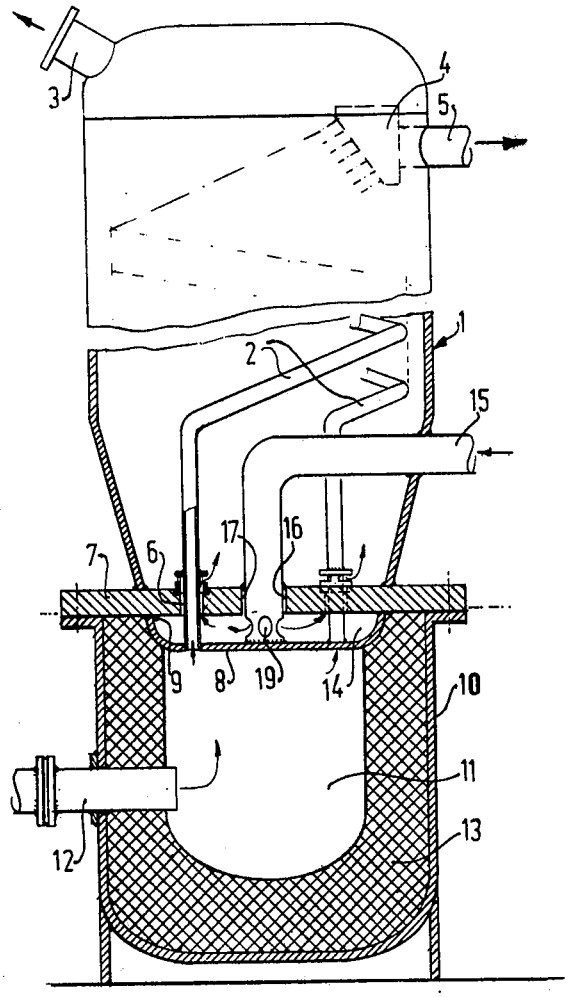
FIG. 1 shows an apparatus according to the invention in section.
Figure 2:
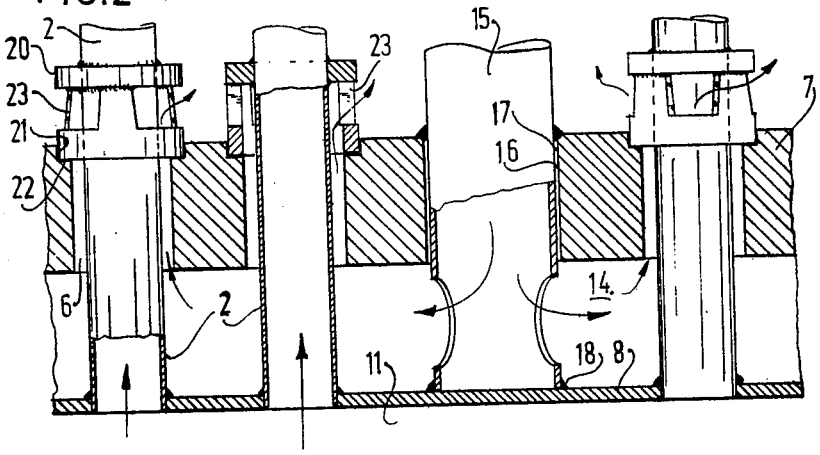
FIG. 2 is a detail of FIG. 1 shown in section on an enlarged scale.

The apparatus comprises a vessel 1 in which the helical convolutions of tubes 2 are accommodated. The vessel has a discharge 3 for cooling water or the like. The tubes 2 adjoin a plurality of collecting boxes 4 which are connected to a discharge 5 for the gas. The tubes 2 project through openings 6 in a heavy support plate 7. The ends of the tubes are secured in a tube plate 8 which is bent at the edges and welded at 9 with the edges to the support plate 7. The support plate 7 is welded to the vessel 1. Furthermore, the support plate rests on a vessel 10 which forms a chamber 11 for the hot gas. The chamber 11 has a supply tube 12 for said hot gas. The vessel 10 is lined on the inside with an insulating layer 13. The latter protects the wall of the vessel 10 which is to withstand the high gas pressure.

Cooling liquid can be supplied to the chamber 14 between the tube plate 8 and the support plate 7 via a tube 15. The tube 15 projects through an opening 16 in the plate 7. Between the wall of the opening 16 and the tube 15, there is a wide gap 17. Near the upper edge of the support plate, the tube 15 is welded to said plate 7. Furthermore, the tube 15 is welded at the end at 18 to the tube plate 8. The tube has openings 19 which open into the space 14. Welded to the tubes 2 is a ring 20. A tubular ring 21 with openings 23 is fixedly welded to the ring 20 and supported in a matching recess 22 in the plate 7 so that the ring 21 and the tube 2 are centered with respect to the opening 16.

Hot gas is supplied through the tubes 12 and can flow via tubes 2 to the discharge 5. When the gas has a very high temperature, for example up to 1500° C., the inner wall of the insulation 13 will assume the same temperature. Because of the direct contact with the gas and the radiation the tube plate 8 also assumes a high temperature on the side of the chamber 11. On the other side the plate is cooled by cooling water from the conduit 15. The plate should not be too thick since otherwise the thermal stresses will be too high. When the vessel 1 has an inner pressure, the pressure forces exerted on the thin tube plate 8 are transmitted to the tubes 2 and the rings 20 and 21 to the plate 7. This support plate thus provides the necessary resistance. When the very hot gases flow through the tubes and cooling water is introduced into the chamber 14 via the conduit 15, the tube is cooled uniformly all over due to the gaps 6 round the tubes 2. In spite of the connection to the plates 7 for supporting the tube plate 8 no overheating of the tubes occurs. Because of the wide gap 17 no gap corrosion occurs between the wall of the hole 16 and the wall of the conduit 15. The number of tubes which can be disposed in the tube plate is not limited because due to the supporting of the tubes the thickness of the plate 7 is independent of the diameter thereof.

What is claimed is:

1. Apparatus for cooling hot gas which consists of a vessel comprising a nest of tubes, the hot gas flowing through the tubes and cooling water or the like flowing round the tubes and the tubes being secured at least at one end in a tube plate which closes a hot gas supply chamber, characterized in that the tube plate is of light construction, that immediately behind the tube plate a heavy support plate supported by the vessel wall is provided, that the tubes project through openings in the support plate, that the tubes rest on the side remote from the tube plate on the support plate via rings which are secured to the tubes, comprise passage openings for the cooling water or the like and adjoin continuous gaps disposed round the tubes, and that the space between the tube plate and the support plate lying therebehind is provided with a supply for cooling water or the like, the supply for the cooling water or the like being formed by a conduit led through an opening in the support plate and sealingly mounted in said plate, the end of said conduit being secured to the tube plate and the portion lying between the tube plate and the support plate comprising openings.

2. Apparatus according to claim 1, characterized in that the supply conduit for cooling water or the like is connected to the support plate only on the side thereof remote from the tube plate and between the portion of the conduit projecting through the support plate and the wall of the opening an encircling gap open at one end is present.

3. Apparatus according to one of claims 1 or 2, characterized in that the rings round the tubes of the nest are welded and are centrally supported by tubular rings comprising openings and fixedly welded or integral therewith, said rings being supported in corresponding recesses of the support plate disposed about the tubes.

4. Apparatus according to one of claims 1 or 2 preceding claims, characterized in that the tube plate is bent in the vicinity of the periphery and the bent edge is welded to the support plate.

5. Apparatus according to claim 4, characterized in that the rings round the tubes of the nest are welded and are centrally supported by tubular rings comprising openings and fixedly welded or integral therewith, said rings being supported in corresponding recesses of the support plate disposed about the tubes.

6. A heat exchanger comprising, in combination:

a first chamber having an inlet for hot fluid and a second chamber having an outlet for heated fluid;

a plurality of tubes disposed in said second chamber, a tube sheet fixed to one end of said tubes and closing off said first chamber to force said hot fluid to pass through said tubes, a manifold connected to the opposite ends of said tubes and an outlet connected to said manifold and passing outwardly of said second chamber, said tube sheet being of thin metal whereby to avoid undue thermal stresses due to the temperature of said hot fluid;

a thick, rigid support plate rigidly fixed peripherally to said tube sheet but spaced therefrom to define an inlet chamber and said support plate being fixed between said first and second chambers to cooperate with said tube sheet and seal off said first and second chambers from each other;

means for introducing the fluid to be heated into said inlet chamber and comprising an inlet conduit extending into said second chamber, through said support plate and to said tube sheet, said support plate having a generally centrally disposed aperture through which said inlet conduit projects, with clearance, and that end portion of said inlet conduit between said support plate and said tube sheet being provided with lateral openings for discharging the fluid to be heated into said inlet chamber, said inlet conduit being fixedly secured both to said support plate and to said tube sheet whereby central regions of said tube sheet and inner plate as well as the peripheries thereof are rigidly joined;

said support plate having enlarged apertures receiving said tubes therethrough to define annular passages therewith which communicate said inlet chamber with said second chamber; and means anchoring said tubes directly to said support plate while still permitting said annular passages to communicate said inlet and second chambers for transferring pressure forces acting on said tube sheet to said support plate and comprising a ring surrounding each tube and rigidly fixed thereto, each ring seating upon said support plate in centered relation within an aperture thereof and each ring having lateral openings communicating the annular passage of its associated tube with said second chamber on that side of said support plate opposite said inlet chamber.

* * * * *